United States Patent [19]

Knappstein et al.

[11] 4,040,910

[45] Aug. 9, 1977

[54] APPARATUS FOR CHARGING COKE OVENS

[75] Inventors: Johannes Knappstein; Josef Stratmann, both of Recklinghausen, Germany

[73] Assignee: Firma Carl Still, Germany

[21] Appl. No.: 684,572

[22] Filed: May 10, 1976

[30] Foreign Application Priority Data

June 3, 1975 Germany ..... 2524462

[51] Int. Cl.[2] ..... C10B 31/04

[52] U.S. Cl. ..... 202/262; 214/18 PH

[58] Field of Search ..... 202/262, 263; 214/18 PH, 35 R; 141/284

[56] References Cited

U.S. PATENT DOCUMENTS

| | | | |
|---|---|---|---|
| 3,576,263 | 4/1971 | Abendroth | 214/35 R |
| 3,682,339 | 8/1972 | Knappstein | 202/262 X |
| 3,764,026 | 10/1973 | Olah | 202/262 X |
| 3,850,756 | 11/1974 | Rossow | 202/262 |
| 3,958,700 | 5/1976 | Foy et al. | 202/262 X |

*Primary Examiner*—Morris O. Wolk
*Assistant Examiner*—Arnold Turk
*Attorney, Agent, or Firm*—McGlew and Tuttle

[57] ABSTRACT

An apparatus for charging coke ovens with coal through filling openings in the coke oven roof comprises a hopper support which advantageously comprises a car undercarriage which is movable into position over an associated filling opening. At least one charging hopper is supported on the support for upward and downward movement and it has a lower end with a discharge connection which is engageable into the filling opening of the coke oven. The support carries a guide for the upward and downward movement of the hopper which is connected to a drive motor in the form of a fluid pressure operated piston and cylinder combination. In one embodiment a compression spring supports the hopper in a fully loaded position and the drive motor which is connected to the hopper must overcome a slight compression force of the spring to move the hopper downwardly to engage the discharge connection into the coke oven opening. In another embodiment the spring pressure does not become effective until a drive connection engages onto a compression spring during the course of its movement with the hopper in a downward direction to further compress the spring toward the end of the downward movement. The construction also includes a separate drive motor for opening and closing a valve in the discharge connection for regulating the discharge of the coke from the hopper into the oven.

13 Claims, 4 Drawing Figures

APPARATUS FOR CHARGING COKE OVENS

BACKGROUND OF THE INVENTION

1. FIELD OF THE INVENTION

This invention relates in general to the construction of coke ovens and in particular to a new and useful apparatus for charging coal into the individual filling openings of each coke oven of a coke oven battery.

2. DESCRIPTION OF THE PRIOR ART

A coke oven charging car is known in which each hopper which is carried on the car is associated with a lowerable and horizontally movable connecting piece which is engageable into the filling frame and into which the outlet connection of the hopper projects. In this construction closure elements are provided which close the feed passage in response to a signal of the filling level meter in the hopper as soon as the coal has been completely discharged except for a residual volume which seals the valve or shutter which operates to close the opening. Such a construction includes in addition to a shutter valve a rotary slide valve which serves as a closure element. Such hoppers are designed with lower ends forming a funnel for transferring the coal from the hopper into the oven. The small residual volume which remains in the hopper seals the space over the shutter valve which is made smaller than the output opening of the hopper. Such a coke oven charging car has proved quite satisfactory in practice and about thirty of these cars are in service. The hoppers of such devices include funnel shaped connecting pieces which are engageable into the filling openings of the coke oven roof and this makes it necessary to locate sensitive mechanism or devices such as hydraulic, pneumatic or electrical or electromagnetical lifting devices and linkages closely adjacent the connecting piece and beneath the service platform in the immediate vicinity of the filling opening of the oven and sometimes particularly during disturbances flames flare up which may damage the parts or even set them on fire. This is hazardous especially with oil hydraulic motors.

In operation it may also occur that the filled charging car is displaced into a position above the oven chamber to be fed and because of a disturbance, the coal is discharged into the oven chamber either completely or only partially. Then the connecting pieces which have already been lowered for the coal discharge are to be retracted and the charging car is to be displaced away from the oven chamber. Consequently at the final discharge of the coal, difficulties may arise since during the preceding retraction of the connecting piece the loose fines received therein have been jolted and compressed. In the connecting piece and therefore in the outlet connecting the hopper the compressed coal obstructs the free discharge and flow of the main volume of the coal. So called "bridges" of compressed coal also tend to form. The formed structures of compressed coal must be cleared or removed by manual work. Also upon formation of a bridge in the hopper, the transfer funnel may become completely emptied and because of the absence of a protective coal cushion, the charging might be exposed to flames flaring up from the oven chamber.

SUMMARY OF THE INVENTION

The present invention provides a charging car which is constructed so as to avoid any fire risk and which has its coal discharge mechanism designed so that at distrubances in operation, the coal received therein cannot become upset or compressed and which includes a discharge arrangement such that the coal is discharged into the oven chamber continuously in a uniform stream and without interruption.

In accordance with the invention there is no separate connecting piece which is separately movable in a horizontal and vertical direction but the hopper itself is mounted so that it may move upwardly and downwardly and the hopper is constructed with a lower conical end leading into a tubular connecting piece which fits into the charging hole or opening of each furnace oven. The whole hopper including the connecting piece is mounted on an undercarriage of a charging car on a support which permits its horizontal and vertical movement. The devices for permitting the movement of the hopper are provided within the zone of and above the protecting service platform. A charging car constructed in accordance with the invention cannot be damaged by flames which flare up from the opening of the coke oven and neither can any equipment such as all hydraulic devices catch fire since they are located far above the filling openings of the oven chambers and in addition are located above a protecting service platform. The platform is advantageously a grating floor of the undercarriage of the car which is provided with solid metal sheets for example checkered plates. With the arrangement the coal itself is also better protected against flames because there is no open gap between the hopper outlet and the connecting piece. In addition a compression and upsetting of the coal received in the connecting piece and thereabove is avoided, since the hopper is firmly connected to the connecting piece and is lifted as a whole.

Advantageously the inventive charging car is designed so that the hopper is supported on compression springs which hold the hopper in a balanced condition on the car upwardly above the oven when it is fully loaded. In another embodiment a lowering of the hopper by the action of a drive motor causes the lever member to compress a compression spring so that the hopper is biased upwardly as it moves downwardly into a position at which the connecting discharge piece engages in the coke oven opening. The supporting springs act as relieving devices which insure that the load acting on the hopper does not vary during the dishcarging operation. The compression or release springs which resiliently support the hopper during the movement of the hopper into a discharging position are designed so that they can absorb the entire weight of the filled hopper so that a small motor force must be used in order to press the hopper and the connecting piece into the filling opening. For this purpose one or more compression and relief springs and one or more drive motors may be provided. The compression and relief springs may be leaf springs, cup springs or helical springs. The motors may be pneumatic, hydraulic, mechanical, electromechanical or magnetomechanical in nature.

The horizontal mobility of the hopper for correcting the position of the charging car above the filling openings is obtained for example by providing a universal suspension in connecting joints between a drive piston rod and a connecting part of the hopper.

In charging cars of the prior art, the devices for moving the car alongside the roof of the battery are blocked as long as the connecting pieces of the hopper are lowered into the filling frames. This means however that upon damage or disturbance of the mechanism for lifting the connecting pieces, the charging car cannot be displaced away from the oven chamber and may run the risk of burning out. Therefore in accordance with the invention between the motors for lowering the hoppers there is a simple unlocking mechanism which is manually operated. Upon failure of the motors while the hoppers are lowered, the unlocking mechanism is actuated and the hoppers are then lifted by the action of the spring so that the downward projection of the hoppers will not prevent the longitudinal travel of the car.

Accordingly it is an object of the invention to provide an apparatus for charging coke ovens with coal through filling openings in the roofs of the individual ovens and which includes means for supporting a hopper on a support or undercarriage for upward and downward movement and some horizontal movement for the purpose of shifting a connection piece formed at the lower discharge end of the hopper into a coke oven filling opening and which includes spring means associated with the hopper biasing it in a direction away from the filling opening and drive means for driving the hopper downwardly to engage the connection pieces into the opening for the discharge of the coal from the hopper.

A further object of the invention is to provide a coke oven charging apparatus which is simple in design, rugged in construction and economical to manufacture.

For an understanding of the principles of the invention reference is made to the following description of typical embodiments of the invention as illustrated by the accompanying drawings.

GENERAL DESCRIPTION OF THE PREFERRED EMBODIMENTS

Figure 1:
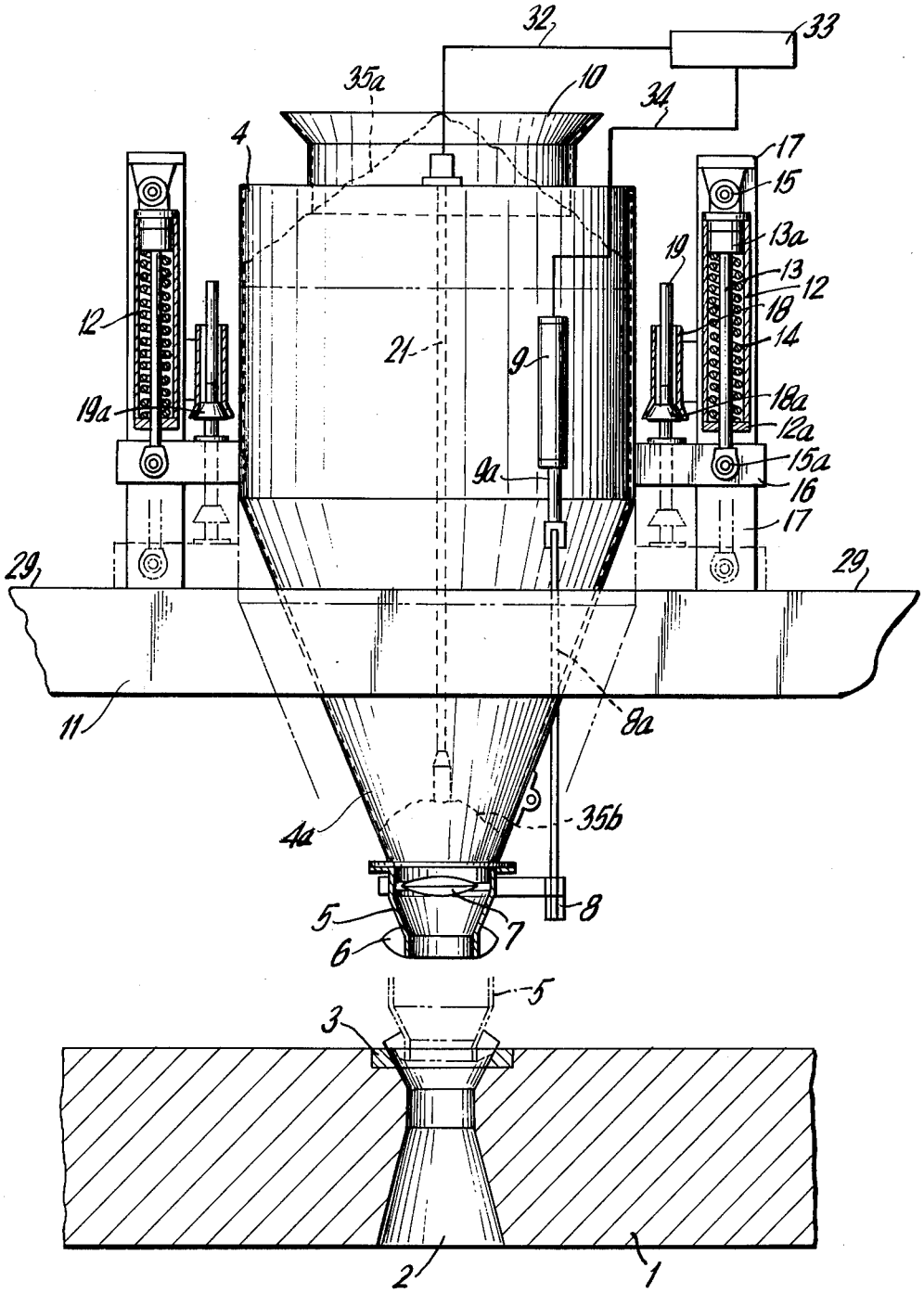
FIG. 1 is a side elevational view partly in section of a coke oven charging device constructed in accordance with the invention.

Referring to the drawings in particular the invention embodied therein in FIG. 1 comprises an apparatus for charging coal into individual ovens of a coke oven battery having a coke oven roof 1 with filling openings 2 associated with each coke oven. The upper end of the filling opening 2 is provided with a filling frame or collar 3 which is engageable by a sealing ring 6 carried in a discharge connecting piece 5 of a coke oven charging hopper 4 constructed in accordance with the invention.

In accordance with the invention a plurality of charging hoppers 4 are carried on an undercarriage or car carriage 11 which is adapted to move over the roof of the coke oven battery in order to position the discharge connection 5 in vertical alignment with the filling opening 2 of each of the coke ovens in turn. The charging car includes an undercarriage 11 having means thereon for supporting each hopper 4 for vertical and some horizontal movement.

The undercarriage 11 includes a top deck or service platform 29 which forms a shield for the operating devices for the hopper located thereabove. The hopper 4 is provided with a conical outlet 4*a* which opens into the connecting piece 5. The connecting piece 5 is provided with a sealing ring 6 which upon lowering engages with the filling frame 3 located in the filling opening 2. The connecting piece contains means for opening and closing at least a part of the cross section through the connecting piece which in the embodiment illustrated comprises a shutter valve 7 which is made somewhat smaller than the total cross section for flow within the connecting piece 5. The position of the shutter valve is controlled by actuating means which includes connecting levers 8 and 8*a* which are connected to a piston rod 9*a* of a motor actuator 9. Motor actuator 9 is advantageously hydraulically operated by admission of fluid pressure through a line 34 into the cylindrical actuator 9 to advance a piston connected to the piston rod 9*a* therein.

Means are provided within the hopper to detect the level of coal therein and in the embodiment shown this comprises a capacitative probe 21 which is connected through a line 32 to a switching station 33 comprising relays, amplifiers and solenoid valves which is effective to operate the pressure line 34 to regulate the pressure delivered to the hydraulic actuator 9. The capacitative probe 21 furnished the control signal for closing the shutter valve 7 as soon as the coal level in the hopper 4 has dropped from the top filling level 35*a* to the bottom level 35*b* in which the level is sufficient only to seal the shutter valve 7.

Supporting structure 17 is mounted on the undercarriage 11 and it carries a plurality of drive motors in the form of hydraulic motors 12, 12 which are universally pivotally mounted on support pivots 15. Each drive motor 12 comprises a cylinder having a piston slidable therein with a piston rod 13 which has a universal joint portion 15*a* universally pivotally connected to bracket 6 to the hopper 4. Compression and relief springs 14 are arranged within the hydraulic cylinders of the drive motors 12 and they bear against cover 12*a* and piston 13*a*. The strength of compression of the springs 14 is chosen so that they support the weight of a completely filled hopper. In accordance with a feature of the invention the hopper is driven downwardly to a discharge position to engage the connecting piece 5 into the opening 2 by the hydraulic drive motors 12. For this purpose only a small residual spring force must be overcome.

During the downward movement the connection 5 may be shifted horizontally as well as vertically into the universal mounting of the hydraulic motors and the piston rods 13.

Guide beams are also employed for guiding the hopper upwardly and downwardly and they include guide rods 19 which slide in guide sleeves 18 which are secured to the supporting structure 17. The bottom portion of the guide sleeves are flared outwardly in a conical form 18*a* so as to receive frustoconical shaped disc bodies 19*a* which are carried on the guide rods when the hopper is in an upper position. At the top of the hopper 4 there is an adjustable filling and measuring cylinder 10 for the hopper. The lowered position of the hopper for discharging coal is shown in dash dotted lines.

Figure 2:
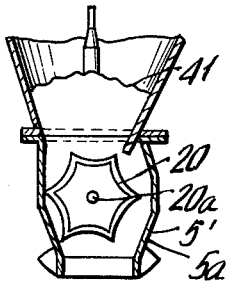
FIG. 2 is a partial sectional view of another embodiment of discharge connection for the hopper shown in FIG. 1.

In FIG. 2 another embodiment of connecting piece 5' for a hopper 4' is indicated. In this embodiment the control valve for regulating the discharge of coal from the hopper comprises a sector wheel shutter valve 20 which is rotatable about a shaft 20*a*.

Figure 4:
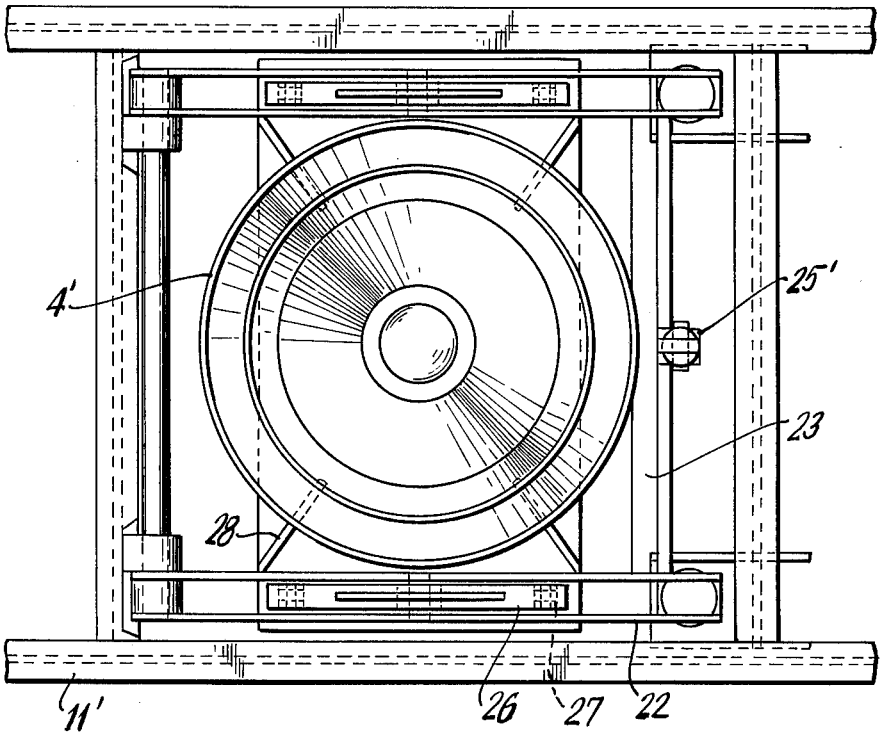
FIG. 4 is a top plan view of the embodiment shown in FIG. 3.
Figure 3:
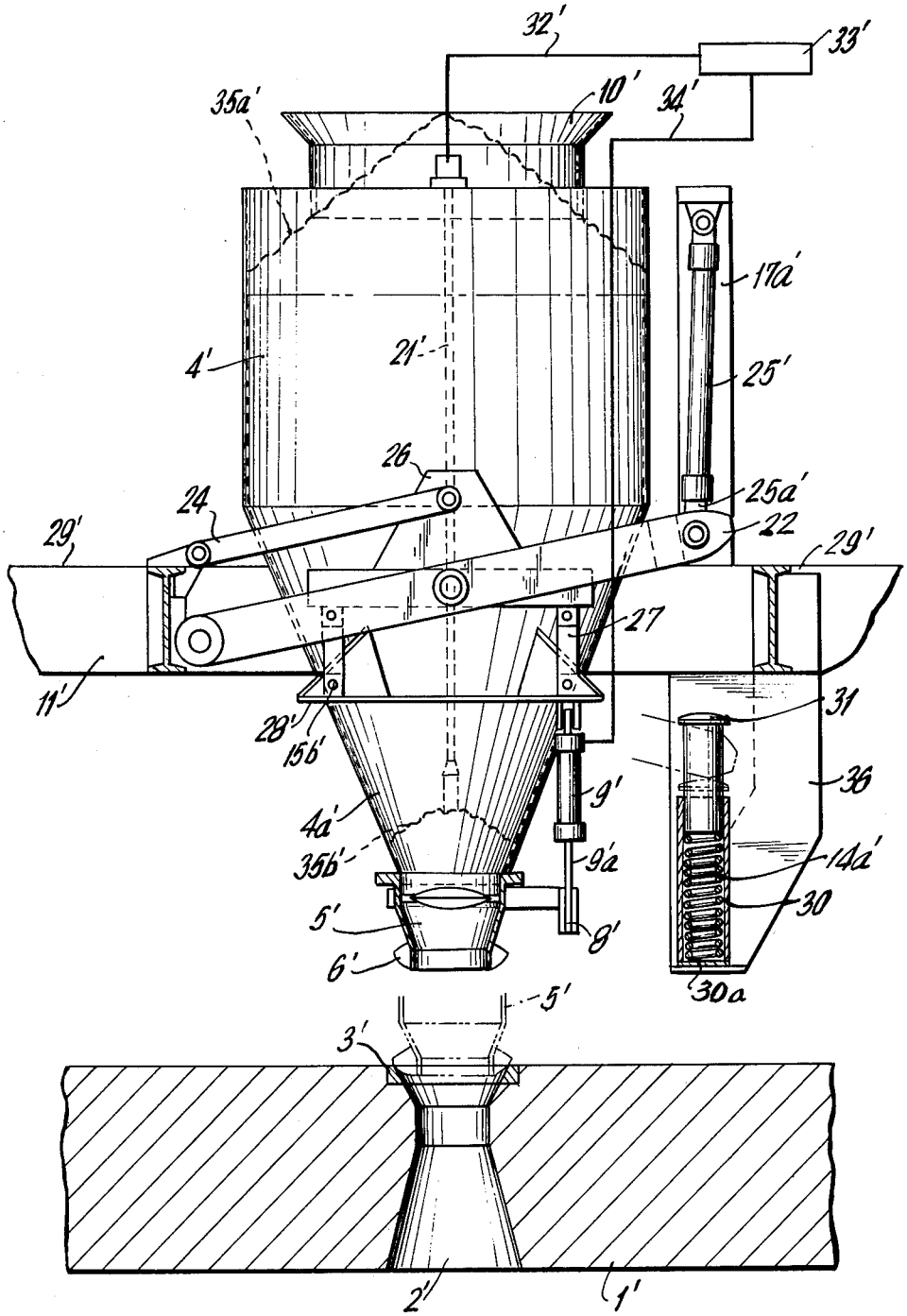
FIG. 3 is view similar to FIG. 1 of another embodiment of the invention.

In the embodiment indicated in FIGS. 3 and 4 similar parts are similarly shown but with primes added.

In this embodiment levers 22 and guide bars 24 are pivotally mounted on the undercarriage 11'. Guide bars 24 are pivoted to cross bars 26 which in turn are suspended from levers 22. The levers 22 are connected to each other through a cross bar 23. The hopper 4' and its supporting plates 29' are suspended from the crossbars 26 by means of hinge rods 27 which have universal connections at each end so that they are movable in all directions. Under-carriage 11' supports a yoke-shaped mounting structure 17*a* from which hydraulic motor 25' is suspended. The hydraulic motor 25' includes a piston 25*a*' which is pivoted through crossbar 23 to levers 22. A guide tube 30 is firmly connected to the under-carriage 11 through a bracket 36. Compression and relief springs 14*a*' rest against a bottom 30*a* of the guide tube 30 and against a pressure ram 31 at its opposite end. The ram 31 is pushed downwardly by the lever 22 when the hopper is moved downwardly through the lowermost portion of its travel at which time the lever 22 contacts the ram 31. Further downward movement exerts pressure on the ram 31 and the springs 14*a*'. This further movement is accomplished by the motor 25' to bring the sealing ring 6' into engagement with the frame 3 of the filling opening 2 of the oven roof 1.

While specific embodiments of the invention have been shown and described in detail to illustrate the application of the principles of the invention, it will be understood that the invention may be embodied otherwise without departing from such principles.

, What is claimed is:

1. An apparatus for charging coke ovens with coal through filling openings in the oven roof, comprising a hopper support positionable over the filling openings, at least one charging hopper adapted to be filled with coal and having a bottom discharge connection engageable in a filling opening, means on said support supporting said hopper for upward and downward movement, and drive means on said support connected to said hopper to move said hopper downwardly to engage said discharge connection into the associated oven filling opening to discharge the coal from said hopper into the oven and to raise said hopper after discharging is completed.

2. An apparatus according to claim 1, wherein said support comprises a service platform forming a support for said hopper and providing a shield for said hopper.

3. An apparatus according to claim 1, wherein said drive means comprises a fluid pressure cylinder, a piston slidable in said cylinder and having a rod connected to said hopper, said cylinder being connected to said support and a compression spring disposed between said piston and said cylinder supporting the weight of said hopper through said piston rod connection to said hopper.

4. An apparatus according to claim 1, including a sealing ring disposed around said discharge connection adapted to engage in the opening of the oven and to be sealed therewith.

5. An apparatus according to claim 1, wherein said drive means comprise hydraulic motors, said support comprising a car undercarriage, said drive means comprising a portion of said means supporting said hoppers for upward and downward movement and including a fluid pressure cylinder pivotally universally suspended from said support and having a piston movable in said cylinder with a rod universally pivotally connected to said hopper.

6. An apparatus according to claim 1, including a valve in said discharge connection, level indicator means in said hopper, and control means connected between said level indicator means and said valve for regulating said valve in accordance with the level of coal in the hopper.

7. An apparatus according to claim 1, wherein said drive means comprises a fluid pressure operated piston and cylinder combination pivotally mounted on said support and pivotally connected to said hopper.

8. An apparatus according to claim 7, wherein the drive means are on opposite sides of said hopper, said hopper having a bracket extending outwardly from opposite sides thereof and being connected to respective piston and cylinder combinations of respective drive means on each side, a guide rod carried on each of said brackets, a tube carried on said support and aligned with each guide rod, said guide rod being movable in each tube.

9. An apparatus for charging coal into coke ovens through filling openings in the oven roof comprising an undercarriage support, first and second spaced upright support structures carried on said undercarriage support, first and second fluid cylinders each having an upper end universally pivotally mounted on an upright support structure and having a piston movable in said cylinder, a piston rod connected to said piston, a hopper disposed between said upright first and second support structures and having a laterally extending bracket on opposite sides universally pivotally connected to each associated piston rod, said hopper having a lower end with a discharge connection engageable into the opening of a coke oven, spring means in each of said first and second cylinders for supporting said piston and the weight of the hopper fully loaded thereon, said piston being displaceable in said cylinder to drive said hopper downwardly against the force of said spring means to position the discharge connection in the opening of the oven.

10. An apparatus according to claim 9, including an upright guide rod on each bracket on each side of said hopper, guide tubes affixed to said support and overlying each guide rod and providing a guide through which said rod extends.

11. An apparatus for charging coal according to claim 9, including a valve in said discharge connection and means for indicating the level of coal in said hopper and for opening and closing said valve in accordance therewith.

12. An apparatus according to claim 11, wherein said valve is a rotatable shutter valve.

13. An apparatus for charging coke ovens with coal through filling openings in the oven roof, comprising a hopper for the coal having a lower end with a discharge connection and an opening through which the coal is discharged, a support carriage, an upright member supported on said carriage, a hydraulic cylinder having an upper end universally pivotally connected to said upright member and having a piston slidable therein with a piston rod connected to said piston, a lever having one end pivotally mounted on said support on a side of said hopper opposite from said upright support member and having its opposite end universally pivotally connected to said piston rod and being pivotally connected intermediate its ends to said hopper, said cylinder and piston comprising a drive motor for driving said piston rod and shifting said lever and thereby moving said hopper downwardly, a holding bracket on said support carriage, a tube carried on said holding bracket, a compression spring in said tube, a ram engageable over the compression spring in said tube and having a top disposed in the path of travel of said lever, said lever contacting said ram to force it downwardly against said spring during the downward movement of said hopper.

* * * * *